United States Patent [19]

Chen et al.

[11] Patent Number: 4,525,218

[45] Date of Patent: Jun. 25, 1985

[54] SELECTIVE HYDROLYSIS OF CELLULOSE TO GLUCOSE WITHOUT DEGRADATION OF GLUCOSE USING ZINC CHLORIDE

[75] Inventors: Li F. Chen, West Lafayette, Ind.; Che-Ming Yang, Clark, N.J.

[73] Assignee: Purdue Research Foundation, West Lafayette, Ind.

[21] Appl. No.: 377,078

[22] Filed: May 11, 1982

[51] Int. Cl.[3] ..... C13K 1/02

[52] U.S. Cl. ..... 127/37; 435/99; 435/105

[58] Field of Search ..... 127/37; 435/99, 105

[56] References Cited

U.S. PATENT DOCUMENTS

| | | | |
|---|---|---|---|
| 3,479,248 | 11/1969 | Nobile | 127/37 X |
| 4,018,620 | 4/1977 | Pengue | 127/37 |
| 4,237,226 | 12/1980 | Grethlein | 435/99 |
| 4,304,649 | 12/1981 | Han et al. | 127/37 X |

FOREIGN PATENT DOCUMENTS

| | | | |
|---|---|---|---|
| 44622 | 1/1982 | European Pat. Off. | 127/37 |
| 57-22695 | 2/1982 | Japan | 435/99 |

OTHER PUBLICATIONS

Chem. Abstracts 98: 91246x; Chen and Gong; 1982.

*Primary Examiner*—Kenneth M. Schor
*Attorney, Agent, or Firm*—Cushman, Darby & Cushman

[57] ABSTRACT

Cellulose is selectively hydrolyzed to glucose without the formation of degradation by-products by pretreating the cellulose to form soluble cellodextrins through treatment with concentrated (60–80%) solutions of zinc chloride. Zinc chloride is then separated from the mixture by extraction with attendant precipitation of the cellodextrin material which is the hydrolyzed, chemically or enzymatically to glucose.

8 Claims, No Drawings

SELECTIVE HYDROLYSIS OF CELLULOSE TO GLUCOSE WITHOUT DEGRADATION OF GLUCOSE USING ZINC CHLORIDE

BACKGROUND OF THE INVENTION

Much research has been conducted in the area of cellulose hydrolysis to produce fermentable sugars, such as glucose therefrom. Cellulose is the most abundant polymer on earth, and is characterized as a straight chain polymer composed of glucose with beta 1,4-linkages. Cellulose may exist in crystalline or amorphous forms. Generally speaking, one can easily hydrolyze amorphous cellulose with dilute acid or enzymes. Crystalline cellulose, on the other hand, is difficult to hydrolize presumably due to a tight physical packing of the cellulose molecules. As a result, degradation of the hydrolysis products is significant as represented by the following scheme:

$$H_2O + \text{cellulose} \xrightarrow{H+} \text{glucose products} \xrightarrow{H+} \text{degradation}$$

Various methods have been touted for decrystallizing cellulose through the use of solvents to precipitate it in an amorphous form. However, there methods all utilize cellulose which is solid, albeit amorphous.

Penque U.S. Pat. No. 4,018,620 describes a method of hydrolyzing cellulose using calcium chloride and dilute acid at a temperature of 100° C. to form a colloid suspension of the cellulose which is the hydrolyzed at a temperature of 120° C. for a period of 30 minutes. Contrary to Penque's findings, and due apparently to an error in the unit and chemistry of Penque's analysis, we have found that the claimed method does provide a complete conversion of cellulose to glucose. According to Penque, 10% (w/v) of newsprint (which contains cellulose and hemicellulose) was hydrolyzed, thereby obtaining a 10% (w/v) reducing sugar solution which is equivalent to 50% of the total reducing sugar.

Because the hemicellulose fraction is very easy to hydrolyze, and since newsprint generally contains at least 15% hemicellulose, one must subtract this value from the yield of glucose from cellulose fraction thereby getting a yield of only 20%. In addition, Penque used Clinitest tablets to quantitate the sugar. These tablets are also reactive to the degraded glucose, (Hydroxymethyl furfural) and do not provide a true reading of reducing sugars. On the other hand, analyzing with "Tes-tape" or glucose analyzer, which is specifically reactive to glucose, would provide a different and more accurate result.

It is thus, desirable to hydrolyze cellulose in a liquid state. Unfortunately, conventional cellulose swelling reagents and cellulose solvents are either too severe for glucose or unable to catalyze the cellulose hydrolysis.

Zinc chloride is known as a cellulose swelling reagent, and swells the cellulose at a concentration range from 60 to 80%, with maximum effect at 75% and 65%. The pH of $ZnCl_2$ at this range on concentration is 0 to −2, and thus is able to provide a catalytic function of cellulose hydrolysis. However, under such conditions glucose is also degraded at a faster rate.

In our concurrently filed application Ser. No. 377,077, titled "Quantitative Hydrolysis of Cellulose to Glucose Using Zinc Chloride", we describe a method for hydrolyzing cellulose to pretreating same with concentrated zinc chloride to liquify the cellulose, thereafter reducing the zinc chloride concentration (e.g. by dilution) and completing acid hydrolysis to form glucose. While that process provides hydrolyzed yields of over 90%, the separation of zinc chloride and glucose is costly.

Accordingly, it is the primary object of the present invention to provide a means for effectively pretreating cellulose with zinc chloride and thereafter separating the zinc chloride from the glucose produced.

This and other objects of the present invention will be more apparent from the discussion which follows.

SUMMARY OF THE INVENTION

Cellulose is selectively hydrolyzed to glucose without the formation of degradation by-products by pretreating the cellulose to form soluble cellodextrins through treatment with concentrated (60–80%) solutions of zinc chloride. Zinc chloride is then separated from the mixture by extraction with attendant precipitation of the cellodextrin material, which is then hydrolyzed, chemically or enzymatically to glucose.

The process according to the present invention generally comprises the steps of:

(a) forming a mixture of cellulose together with zinc chloride, said zinc chloride being in the form of an aqueous solution containing from about 60 to about 80% (preferably about 65 to 76%) by weight of zinc chloride;

(b) heating the mixture formed in step (a) at a temperature of from about 70° to about 180° C. (preferably from about 100° to about 145° C.) for a period of time sufficient to convert the cellulose to a liquid form;

(c) removing the zinc chloride from the mixture by solvent extraction thereby precipitating the partially hydrolyzed cellulose in the form of cellodextrins; and (d) separating the precipitated cellodextrins from the extraction media;

(e) hydrolyzing the precipitated cellodextrin to glucose.

It is important that the zinc chloride be removed as soon as the cellulose has been liquified—i.e. as soon as the cellulose has been partially hydrolyzed to form soluble cellodextrins to avoid glucose degradation and formation of such undesirable by-products as hydroxymethylfurfural.

We have found that if cellulose is only partially hydrolyzed to soluble cellodextrins, the $ZnCl_2$ may be recovered by the addition of $H_2O$, acetone, ethanol, ether, or other organic solvents. In the presence of such solvents, the cellodextrin precipitates and $ZnCl_2$ remains in the solvents. Summarizing the present process provides an improved means for producing glucose with removal of zinc chloride prior to glucose formation by:

1. Liquifying cellulose with $ZnCl_2/H+$ or $ZnCl_2$ and partial hydrolyzing cellulose to a water soluble cellodextrin.

2. Recovering $ZnCl_2$ by extraction with $H_2O$, acetone, methanol ethanol, ether or other suitable solvents.

3. Hydrolyzing water soluble dextrins to glucose by dilute acid or enzyme action.

DETAILED DESCRIPTION OF THE INVENTION

We have found that glucose can be dissolved in ethanol, acetone and other organic solvents in the presence of a high concentration of zinc chloride, but cellodextrin or higher glucose polymers do not dissolve in acetone, ethanol and other organic solvents. Thus, zinc chloride can readily be separated from the partially hydrolyzed cellulose, and the partially hydrolyzed cellulose (i.e. cellodextrins) can be further hydrolyzed to glucose in the absence of zinc chloride. Tests indicate that only water soluble cellodextrin can be readily hydrolyzed to glucose after the separation of zinc chloride. The present process therefor provides a means for the recycling of zinc chloride.

The hydrolysis of cellulose to form the cellodextrin can be carried out with and without the presence of acid, since the cellulose is a solution it can be hydrolyzed randomly. The distribution of molecular weight at certain reaction times is governed by the hydrolysis rate of cellulose and degradation rate of glucose. The hydrolysis rate and degradation rate is a function of temperature and the concentrations of acid and zinc chloride as discussed below.

For the convenience of recycling zinc chloride, the reaction may be stopped at a point where the fraction of soluble cellodextrin is at the maximum. These points depend on the temperature and concentration of zinc chloride and acids, and are easily determined by the chemist.

The solution of partially hydrolyzed cellulose is then added to acetone or ethanol (or other organic solvents). All of the cellodextrins will precipitated out with the exception of glucose.

Zinc chloride is soluble in acetone, ethanol, ether, and some other organic solvents. These organic solvents can then evaporated and recycled if desired. Zinc chloride and glucose may be further heated. Upon heating, glucose forms active charcoal with the evolution of gas, and zinc chloride can be separated easily and then recycled. Alternatively chloride may be recycled in the presence of glucose.

The cellodextrin precipitate may then be subjected to a stripping of solvent by either steam or air. Acid solution can then be added to the cellulose for further hydrolysis.

In forming the initial mixture of cellulose and zinc chloride solution, we have found that the maximum amount of cellulose which may be added to the concentrated zinc chloride solution is about 1 gram of cellulose for each 2 ml of zinc chloride solution.

As noted above, we have also found that the degradation rate of glucose is affected by temperature, the concentration of $ZnCl_2$, and acid. The rate of glucose degradation can be expressed as:

$$K_{DEG}=2.23\times 10^{3}([ZnCl_2]4.53+4.62[H^+]^{0.544})\times e^{-2.185\times 104/RT-20.85[H+]^{0.551}}$$

This means that lower acid, $ZnCl_2$ concentration, and low temperature stabilizes glucose. However the concentration of $ZnCl_2$ that can dissolve cellulose is detrimental to the glucose. Fortunately, the data indicates that the dissolved and partially hydrolyzed cellulose can remain in solution at a lower concentration of $ZnCl_2$ achieved in accordance with the present invention.

The following examples are offered to more fully illustrate the invention, but are not to be construed as limiting the scope thereof.

EXAMPLE 1

Material and Methods

Avicel was used as noted as a source of cellulose. Cellulase from *Trichoderma verdi* was used for enzymatic hydrolysis. This enzyme was fractionated by 50% saturated ammonium sulfate to remove glucan. The protein content of the purified enzyme is 20% determined by Lowry's method with hovine serium albumia as standard.

Pretreatment of Cellulose

Avicel 10 gm was wetted with 12 ml of water. 50 ml of 74% $ZnCl_2$ solution containing 0.5% (w/v) HCl was added to the wetted avicel. The cellulose solution were then subjected to heating with the temperature ranging from 100° C. to 145° C. The heating time ranging from 6 minutes to 20 minutes. The heated cellulose now reduced to cellodextrin is then cooled by setting at room temperature or cooled by plunging the reactor cell in the ice slurry. The cellodextrin is precipitated by adding 25 ml of acetone per gram of cellodextrin to the cellulose solution. The precipitated cellodextrin was washed with 25 ml of acetone per gram of avicel for 4 times. The cellodextrin was then vacuum dried to remove acetone. The cellodextrin thus obtained was in lumps which were then resuspended in water and freeze dried. The freeze dried samples are powdery particles. 0.8 gm cellodextrin was suspended in 2 ml of sodium acetate buffer (pH 4.8, 0.05M) and 2 ml of enzyme in buffer solution was then added to this suspension with the final enzyme concentration of 0.01%, 0.1%, 0.5%, 2.5% and 5% (w/v). The samples were incubated at 48° C. in a shaker bath. 8 tiny glass beads were added to assist the agitation with and form glucose.

EXAMPLE 2

One gram of Avicel is swollen and hydrolyzed in 65% $ZnCl_2$ aqueous solution. After 4 hours of heating to 100° C., 80% of cellulose becomes water soluable dextrin. Fifteen percent of the cellulose is hydrolyzed after acetone extraction to glucose using dilute hydrochloric acid.

The invention having been thus described, it will be appreciated that various departures may be therefrom within the scope of the claims which follow.

We claim:

1. A process for the selective hydrolysis of cellulose solids to glucose without degradation of the glucose, which process comprises the steps of:

(a) forming a mixture of cellulose solids together with zinc chloride, said zinc chloride being in the form of an aqueous solution containing from about 60 to about 80% by weight of zinc chloride;

(b) heating the mixture formed in step (a) at a temperature of from about 70° to about 180° C. for a period of time sufficient to convert the cellulose to a liquid form without appreciable formation of glucose;

(c) removing the zinc chloride from the mixture by solvent extraction thereby precipitating the partially hydrolyzed cellulose in the form of cellodextrins; and (d) separating the precipitated cellodextrins from the extraction media;

(e) hydrolyzing the precipitated cellodextrin to glucose.

2. The process of claim 1 wherein the concentration of zinc chloride in step (a) ranges from about 65 to 76% by weight.

3. The process of claim 1 wherein step (e) is carried out chemically using an acid selected from the group consisting of hydrochloric, sulfuric, nitric, phosphoric and acetic acid.

4. The process of claim 1 wherein step (e) is carried out enzymatically.

5. The process of claim 1, claim 3, or claim 4 wherein the solvent used for extraction in step (c) is an organic solvent.

6. The process of claim 5 wherein said solvent is acetone, ether, methanol, or ethanol.

7. The process of claim 1 wherein the zinc chloride solution contains up to 5% acid.

8. The process of claim 7 wherein said acid is selected from the group consisting of hydrochloric, sulfuric, nitric phosphoric and acetic acid.

* * * * *